US005573028A

United States Patent [19]

van der Stigohel

[11] Patent Number: 5,573,028

[45] Date of Patent: Nov. 12, 1996

[54] STABLE TENT

[75] Inventor: Aart J. W. van der Stigohel, Wassenaar, Netherlands

[73] Assignee: T. A. Pelsue Company, Denver, Colo.

[21] Appl. No.: 199,941

[22] Filed: Feb. 22, 1994

[30] Foreign Application Priority Data

Feb. 22, 1992 [NL] Netherlands ..... 9300324

[51] Int. Cl.[6] ..... F04H 15/48

[52] U.S. Cl. ..... 135/147; 135/119; 135/907

[58] Field of Search ..... 135/103, 106, 135/107, 108, 109, 114, 115, 118, 119, 907, 140, 139, 141, 135, 143, 147, 151, 153, 128

[56] References Cited

U.S. PATENT DOCUMENTS

| | | | |
|---|---|---|---|
| 2,788,011 | 4/1957 | Turner | 135/4 |
| 2,808,065 | 10/1957 | Ellis | 135/108 |
| 2,989,967 | 6/1961 | Lee | 135/107 X |
| 3,165,111 | 1/1965 | Foster | 135/107 X |
| 3,766,932 | 10/1973 | Sidis et al. . | |
| 3,810,482 | 5/1974 | Beavers . | |
| 3,838,703 | 10/1974 | Zeigler | 135/4 |
| 4,506,688 | 3/1985 | Bethoon et al. | 135/140 |
| 4,637,748 | 1/1987 | Beavers | 403/170 |
| 4,665,935 | 5/1987 | Nichols . | |
| 4,819,680 | 4/1989 | Beavers | 135/104 |
| 4,974,621 | 12/1990 | Lerma . | |
| 5,069,572 | 12/1991 | Niksic . | |

FOREIGN PATENT DOCUMENTS

| | | |
|---|---|---|
| 10422771 | 4/1990 | European Pat. Off. . |
| 3707621 | 2/1988 | Germany . |
| 7117078 | 6/1972 | Netherlands . |

OTHER PUBLICATIONS

Drawing for "Fabric Adjustment Strap" dated Apr. 3, 1984 by Creative Fabric Systems.

Drawing for "Cable Assyl With Cable Tension Lever" dated Oct. 27, 1981, by T. A. Pelsue Company.

Drawing for "Cable Tension Lever" dated Nov. 28, 1988, by T. A. Pelsue Co.

*Primary Examiner*—Lanna Mai

*Attorney, Agent, or Firm*—Rothgerber, Appel, Powers & Johnson LLP

[57] ABSTRACT

The invention relates to a collapsible shelter comprising a cloth of supple, sheet-like material and of at least one frame for stretching the sheet-like material, said frame being provided with at least one hub and with rods having high bending strength, said rods being hingably connected to the hub, in a plane perpendicular to the hub, and being hingable relative to the hub beyond a dead center, at least a number of said rods being connected at their free ends with the sheet-like material. The shelter includes a pull cord which is secured at one of its ends to the material and is positioned through a cord eyelet mounted at the free end of the rod so that the material can be pulled outward from the hub toward the free end of the rod, with the other end of the cord being releasably secured in a clamp located on the rod between the eyelet and the hub.

3 Claims, 2 Drawing Sheets

FIG. 3
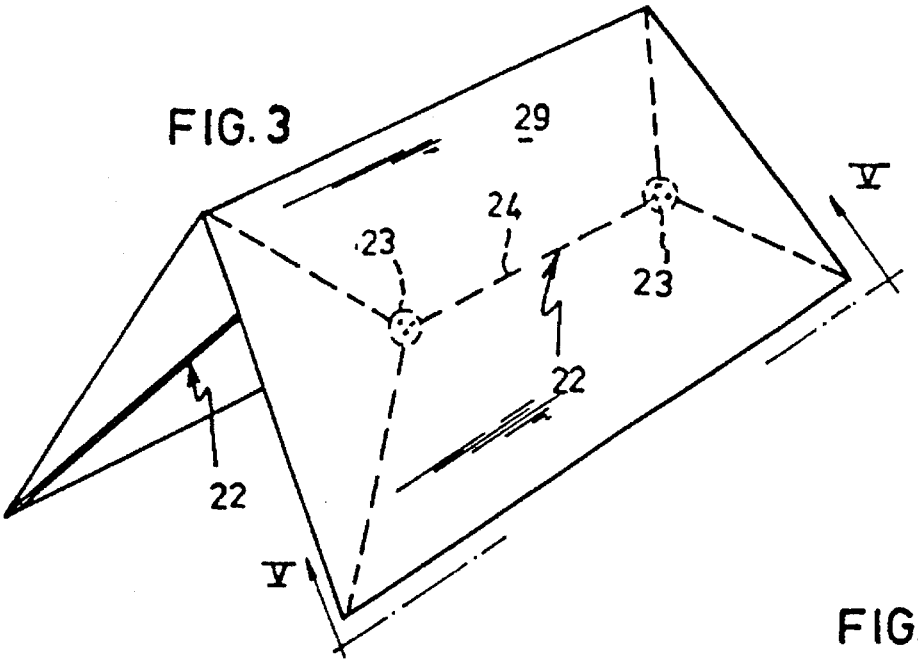
FIG. 4
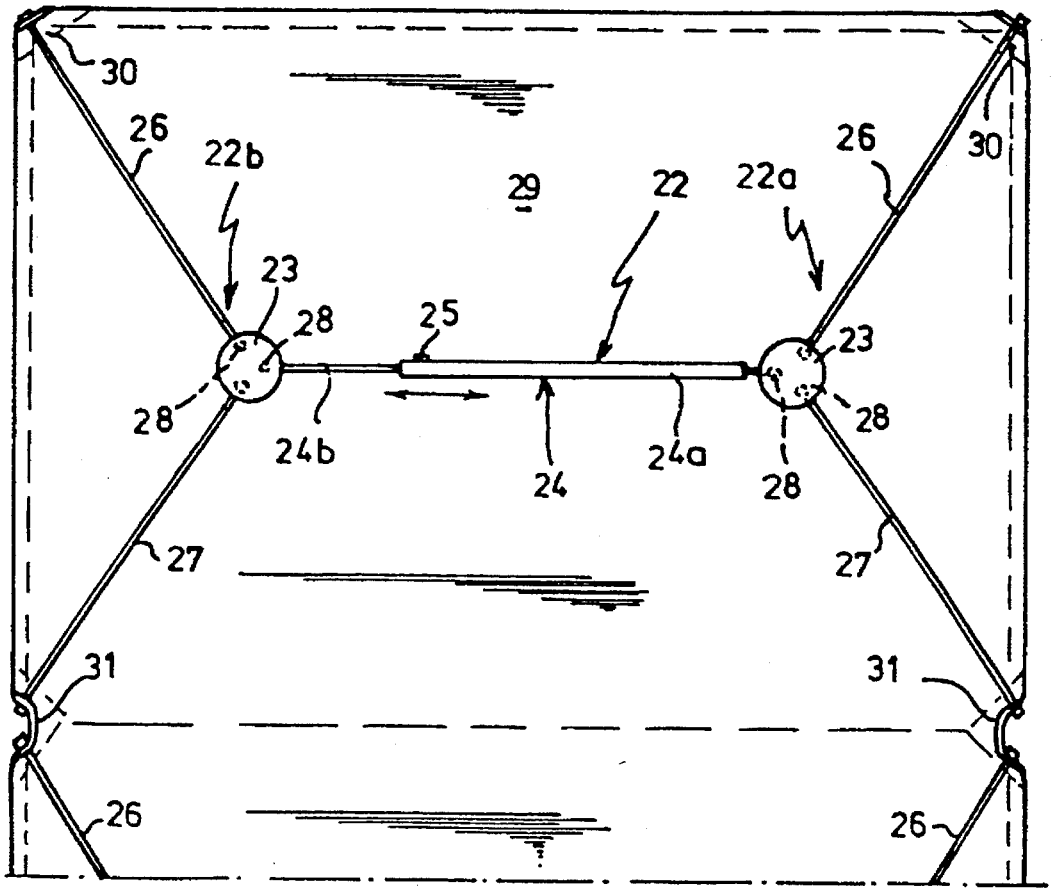
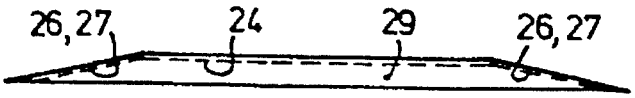
FIG. 5

STABLE TENT

BACKGROUND OF THE INVENTION

The invention relates to a tent or other sheltering device, consisting of a cloth of supple, sheet-like material and of at least one frame for stretching the sheet-like material, said frame being provided with at least one hub and with rods having high bending strength, said rods being hingably connected to the hub in a plane perpendicular to the hub, and being hingable relative to the hub beyond a dead center, at least a number of said rods connected at their free ends with the sheet-like material.

Such a tent is known from U.S. Pat. No. 3,810,482. This patent describes a collapsible tent consisting of three side walls arranged at approximately right angles to each other and a top wall. Each panel consists of a rectangular or trapezoidal panel of tent cloth and a frame, connected with the cloth panel at its corners. Each frame consists of a hub and four frame rods hingable in a plane perpendicular to the hub, said frame rods being hingable and collapsible in a position parallel to each other and approximately perpendicular to the hub and being hingable from this position over an angle exceeding 90° beyond a dead center in which the rods are in one plane. In this existing tent, stretchable cords have been attached along the edge forming the circumferential edge of each panel, which cords are tied together at the corners of the panel, such that an endless loop is formed around each panel, which is constantly under tensile stress, when the tent is erected.

An important drawback to the existing tent is that in larger sizes it is difficult to stabilize in strong winds. As panel sizes increase, the force applied to the exterior of the panel by a strong wind may exceed the erecting force that may be applied by a single worker from the inside, thereby allowing the frame and hub to push inward past the dead center, so that there is a significant risk of the tent collapsing. By tensioning the stretchable cords and tying them together, essentially only the corners of the tent cloth panel are pulled towards each other in circumferential direction, as a result of which the tent cloth between the corners will in fact sag.

OBJECTS OF THE INVENTION

It is the object of the invention to remove this drawback of the existing tent described previously.

SUMMARY OF THE INVENTION

This object is realized, in that according to the present invention the tent is characterized by means for stretching the cloth and the frame relative to each other and by adjustable means for securing the stretching means.

By applying these measures the cloth and the frame may be displaced, adjusted and secured relative to each other, so that the tent cloth and the frame are hardly movable relative to each other and that they bias each other, as a result of which the danger of the panels being pushed inward is greatly diminished if not virtually eliminated.

In a preferred embodiment of the tent of the present invention the stretching means and the adjustable securing means are connected with at least one rod of the frame connected to the hub. As a result, the cloth is stretched in the direction of the frame rods.

In an especially efficient embodiment of the tent of the present invention the stretching means and the adjustable securing means consists of a pull cord, secured at its one end to the cloth, which subsequently runs through a cord eyelet mounted on a rod, and is adjustably securable in a cord clamp onto the rod, such that the securing point of the pull cord on the cloth is situated between the cord eyelet and the cord clamp and the cord eyelet is closest to a free end of the rod. In this embodiment of the covering device the cloth and the frame may very easily and quickly be stretched and secured relative to each other by holding the cloth or the rod, tightening the cord by its free end and inserting it in the cord clamp.

The invention is further elucidated in several embodiments as depicted in the drawings.

BRIEF DESCRIPTION OF THE DRAWINGS

FIG. 3 is a perspective view of another embodiment of the shelter or covering device according to the invention also in the shape of a tent.

FIG. 4 is an inside view of the tent according to FIG. 3 in flattened condition.

FIG. 5 is a view along line V—V in FIG. 3.

DETAILED DESCRIPTION OF THE INVENTION AND THE PREFERRED EMBODIMENT

Figure 1:
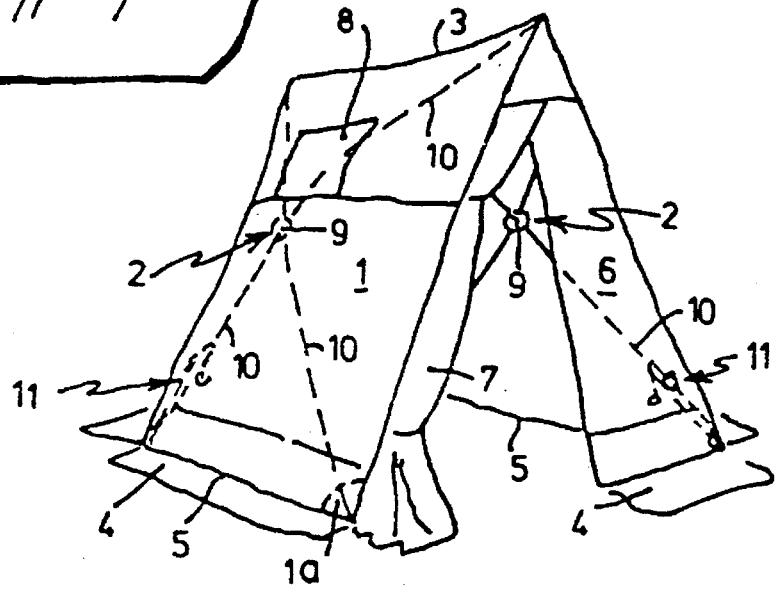
FIG. 1 is a perspective view of an embodiment of the shelter or covering device according to the present invention in the shape of a tent.

The shelter-like tent according to FIG. 1 has a tent cloth 1 and two stretching frames 2. The tent cloth 1 consists of two equal parts connected with each other from one piece along a ridge 3. The tent according to FIG. 1 is furthermore provided on the lower edge of the tent cloth 1 with so-called "skirts" 4 along the lower edges 5 of the tent cloth 1, the function of which is described later. Furthermore, the tent according to FIG. 1 also has two "door halves" 6 and 7 and a "window" 8. The tent cloth 1 herein consists of woven cloth, of which the intersecting threads run horizontally and vertically. As a result, the cloth 1 is deformable in a diagonal direction. The circumferential edges of a panel of the tent cloth 1 may be double-stitched or otherwise constructed for wear resistance in a manner that renders the edge far less elastic than the tent material in general.

The stretching frame 2 consists of a hub 9 and in the illustrated embodiment four frame rods 10 which are rotatable over an angle exceeding 90° in a plane perpendicular to the hub 9 from a position, in which they are parallel to each other and are substantially perpendicular to the hub 9. In doing so, the hub passes through "dead" center, in which the rods 10 and the hub 9 are substantially in one plane.

The tent according to FIG. 1 may further be provided with a back wall, not illustrated, opposite "door halves" 6 and 7.

In the shelter or covering device of the present invention, as illustrated in FIG. 1, each stretching frame 2 is preferably provided with a mechanism 11 on one of the rods resting on the ground or on another support face, said mechanism 11 consisting of means for stretching the cloth 1 and the frame 2 relative to each other and of adjustable means for securing the stretching means. This mechanism 11 has been drawn in detail in FIG. 2.

Figure 2:
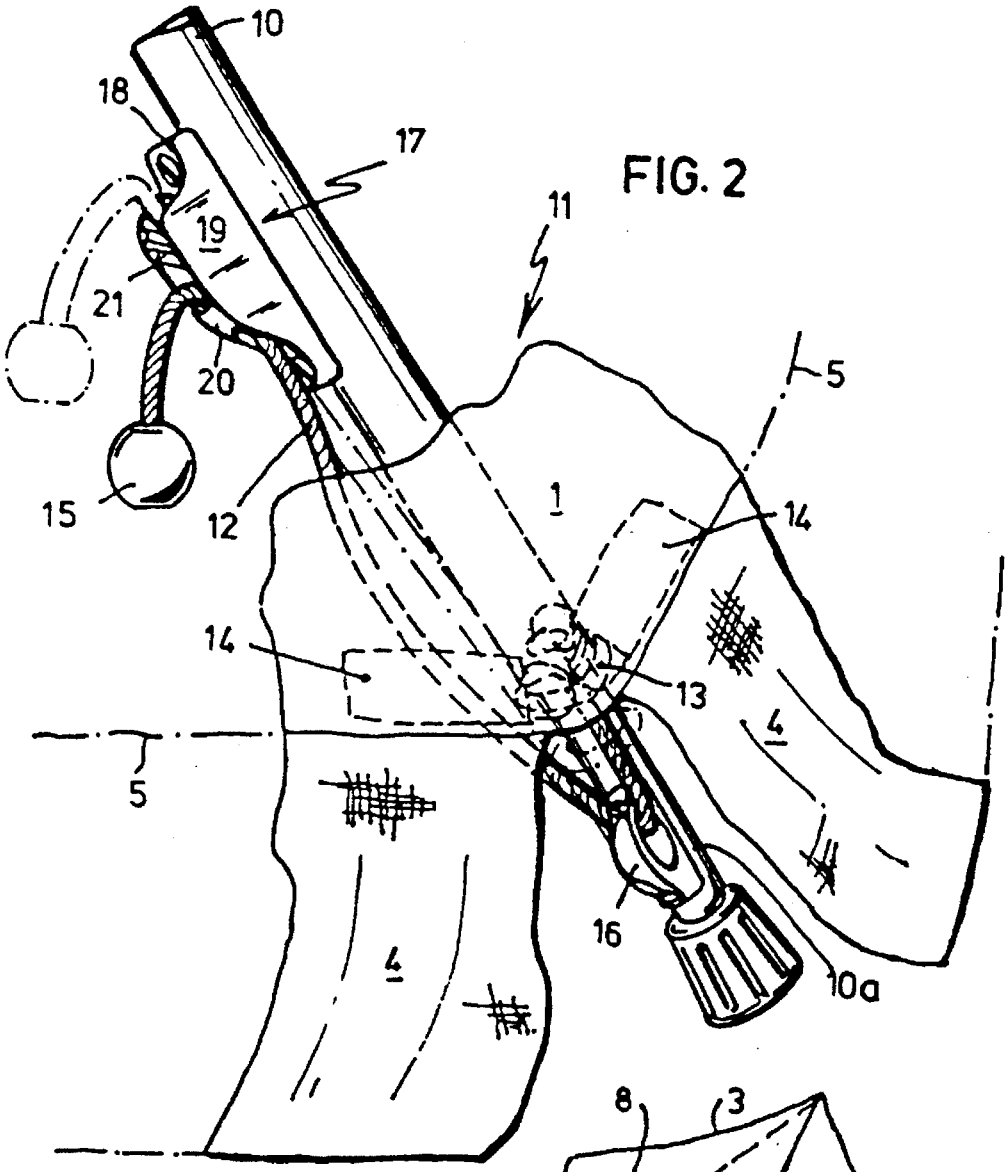
FIG. 2 is a perspective view of the stretching means and the adjustable securing means with a portion of a frame rod of the covering device according to the invention.

The mechanism 11 according to FIG. 2 consists of, among other things, a pull cord 12, secured to the tent cloth 1 at its one end by means of a ring 13. The ring 13 is secured to the tent cloth 1 by means of the fixing pads 14 and is slidable over a thinner portion 10*a* of the frame rod 10, the transition to the thicker portions of the rod 10 serving as a stop. The pull cord 12 is provided with a knob 15 on the free end. The mechanism 11 further comprises a cord eyelet 16 and a cord clamp 17, mounted on the rod portion 10*a* and the rod 10, respectively. The cord 12 runs downward from the ring 13 past the rod portion 10*a* through the cord eyelet 16 and subsequently upward past the rod portion 10*a* and the rod 10 and through the cord clamp 17. Herein the above-mentioned parts are arranged in such a way, that the fastening ring 13 of the pull cord 12 on the cloth 1 is situated between the cord eyelet 16 and the cord clamp 17, and the cord eyelet 16 is situated closest to the free end of the rod 10, 10*a*. The cord eyelet 16 and the cord clamp 17 are not aligned in axial direction of the rod 10, 10*a*, but are preferably shifted in circumferential direction relative to each other, such that the cord 12 between the ring 13 and the cord eyelet 16 and between the cord eyelet 16 and the cord clamp 17 is substantially parallel to the longitudinal center line of the frame rod 10, 10*a*.

The cord clamp 17 consists of an elongated holder, having a U-shaped cross section and being mounted on the rod 10 with the bottom 18 of the holder. The limbs 19 of the holder are locally connected to each other by a bridge 20, situated on the side of the limbs 19 of the holder facing the free end of the rod 10, 10*a* and serving as carrier for the cord 12. Furthermore, both limbs 19 of the holder 17 are provided on the inside with barb-shaped ribs 21, enclosing an acute angle with the rod 10, said acute angle being open on the side facing away from the cord eyelet 16, said ribs converging in the direction of the bottom 18.

In the stretching frame 2, the free ends of the rods 10, which are not provided with the mechanism 11, are for instance inserted in pockets 1*a* on the corners of the tent cloth 1, said insert pockets also reinforcing the corners of the tent cloth. The rod ends may of course also be secured to the tent cloth in a different manner.

The operation of the mechanism 11 and the effect thereof on the tent cloth 1 is the following. It is assumed that the tent is erected as drawn in FIG. 1 and that the mechanism 11 is in the position drawn with full lines in FIG. 2. The tent will remain in that position because the frame rods 10, which are substantially in alignment with each other, enclose an obtuse angle of about 170°, the vertex being directed outward relative to the tent, so that the stretching frame 2 and the tent cloth 1 are pushed outward in a slightly pyramidal shape.

In order to fasten or secure for instance the tent according to FIG. 1 in the position as drawn, one of the skirts 4 of the tent cloth 1 is brought inside the tent, one foot is put on the skirt 4 and the cord 12 is pulled by the knob 15 through the cord clamp 19 past the rod 10 to the hub 9 and then it is released. In doing this, the tent cloth 1 is shifted along the frame rod 10, 10*a* towards the free end thereof and stretched, the ribs 21, after the cord 12 has been released, forcing the cord 12 towards the bottom 18 of the cord clamp 17 under influence of the tractive force on the cord, and then clamping the cord 12. The cord 12 is retained in the cord clamp 17 by the tractive force therein.

As a result, the frame rod 10 is pushed towards the hub 9 in longitudinal direction relative to the tent cloth 1. The same happens with the other rods 10 of the frame 2, which are not provided with the mechanism 11, because by pulling the cord 12 a tensile stress is created in the perimeter 5 of the tent cloth 1, which is secured to the free ends of the rods 10 in the corners and thus all rods 10 of the frame 2 are pushed in longitudinal direction towards the hub relative to the tent cloth. Owing to this, the outwardly directed, slightly pyramidal position of the frame 2 and of the tent cloth is secured or fixed.

In order to release the frame 2 from the tent cloth, respectively, one only needs to pull the cord 12 from the cord clamp 17 towards oneself and allow it to hang over the bridge 20. Thereby, all rods 10 of the frame 2 have been returned into the freely hingable position relative to the hub 3.

The tent or sheltering device according to the invention, drawn in FIGS. 3, 4 and 5, also consists of a tent. Two stretching frames 22 are used, but of course the invention is not restricted to this embodiment. The stretching frame 22 may for instance be employed equally well in tents in the shape of an inverted U, which are provided with three panels, each equipped with a stretching frame, wherein a back panel having a stretching frame may also be provided.

Each stretching frame 22 consists of two hubs 23, hingably connected to the free ends of a rod-shaped connecting member 24, consisting of two parts which are mutually telescopically slidable and fastenable, namely a tube 24*a* and for instance a rod 24*b*, being for instance fastenable relative to each other with a screw 25. Two other rods 26 and 27 are also hingably connected to each hub 23 such, that the hinges 28 of the three rods 24, 26 situated and 27 are situated approximately at the vertices of an equilateral triangle and that the three rods 24, 26 and 27 are arranged substantially Y-shaped at each hub 23 in a flat-lying condition of the frame 22, the "vertical legs" of the Y-shaped half-frames 22*a* and 22*b* being connected telescopically slidable and fastenable to each other. The rods 24*a*, 26, 27 and 24*b*, 26, 27 each enclose an angle of about 120°, which angle may also be bigger or smaller, depending on the length of the tent panel in which the frame 22 is mounted.

Although it is preferred to use for the rod 24 a tube construction which is telescopically slidable and fastenable, other embodiments for the rod 24 are also conceivable; for instance, a buckling rod/tube could be used, wherein a cylindrical socket provided with a fastening means can be slid over the buckle or hinge point, a construction which is employed in stands of sun-shades and the like.

The rods 24*b*, 26 and 27 can be solid rods, but also tube or other profiles. The fastening screw 25 may also be replaced by a different construction, for instance by a radial spring pawl on the rod or tube 24*b*, projecting through a hole in the tube 24*a*. Furthermore, the free ends of the rods 26 and 27 may be secured to the corners of the tent cloth 29 in a manner which is known, i.e., the corners are provided with insert pockets 30 and 31 and/or being reinforced in another way.

The connection between the hubs 23 and the rods 24*a*, 26, 27 and 24*b*, 26 and 27, respectively, of the stretching frame 22 may be constructed and executed in the same way as with the stretching frame 2 of the embodiment according to FIGS. 1 and 2. In the frame 22, too, the rods 24, 26 and 27 are hingable over an angle exceeding 90° in plane perpendicular to the hub from a collapsed position, in which they are substantially parallel to each other and substantially perpendicular to the hub 23, into a position in which they have passed beyond a "dead center," in which dead center the rods 24, 26 and 27 are substantially in one plane. In the final position of the rods 24, 26 and 27, they are positioned in a slight pyramidal fashion relative to each other and this position of the frames and of the tent cloth 29 is represented in FIG. 5.

When the tent is erected, as drawn in FIG. 3, the stretching frames 22 may be adjustably secured by telescopically extending the rod portions 24*a* and 24*b* and by tightening the fastening screw 25 in this stretched condition of the frame 22 and the tent cloth 29. Thereby, each movement of the rods 24, 26 and 27 relative to the hub 23 is blocked.

In order to collapse the tent according to FIGS. 3, 4 and 5, only the screw 25 needs to be unscrewed and the rod portions 24*a* and 24*b* need to be slid into each other, after which the rods 24, 26 and 27 can be hinged relative to the hub 23 into a position parallel to each other.

The tents according to FIGS. 1 and 3 are provided with a tent cloth 1 or 29 respectively, of sheet-like supple, flexible, foldable and rollable material, for instance textile reinforced with synthetic material. However, it would also be possible to use only sheet-like synthetic material, leather, textile, metal foil and the like.

The description and examples set forth herein are intended to illustrate representative embodiments of the invention. The claims which follow are not intended to be limited to the specific disclosed embodiments. The invention is susceptible to modification, variation and change without departing from the proper scope or fair meaning of the following claims.

I claim:

1. A collapsible shelter comprising a cloth of supple, sheet-like material and at least one frame for stretching the sheet-like material, said frame being provided with at least one hub and with rods having high bending strength, said rods being hingably connected to the hub so that the rods may move in a plane perpendicular to the hub and to a position relative to the hub beyond a dead center, at least a number of said rods being connected at their free ends with the sheet-like material, a pull cord which is secured at one of its ends to said sheet-like material, said pull cord being positioned through a cord eyelet which is mounted at the free end of a rod so that the sheet-like material can be pulled outward from the hub toward the free end of said rod and a cord clamp, located on the rod, between said cord eyelet and said hub, for connecting the other end of said pull cord to the rod when the sheet-like material has been pulled outward to provide stability to the shelter where the rods are in the position past dead center relative to the hub and for releasing the pull cord from said rod to permit freely hingable movement of the rods past dead center relative to the hub.

2. The shelter according to claim 1, characterized in that the cord clamp consists of an elongated holder, having a substantially U-shaped cross section with two limbs disposed substantially over its whole length, the distance between the limbs being smaller than the diameter of the cord.

3. The shelter according to claim 2, characterized in that at least one of the limbs is provided on the inside with barb-shaped ribs which are inwardly inclined, such that they guide and securely clamp the cord under the influence of the pulling force exerted thereon to the bottom of the U-shaped holder.

* * * * *

UNITED STATES PATENT AND TRADEMARK OFFICE

CERTIFICATE OF CORRECTION

PATENT NO. : 5,573,028
DATED : November 12, 1996
INVENTOR(S) : van der Stigchel

It is certified that error appears in the above-indentified patent and that said Letters Patent is hereby corrected as shown below:

On the title page:

Item [19] name of inventor reading "van der Stigohel" should read--van der Stigchel--.

Signed and Sealed this

Fourth Day of March, 1997

Bruce Lehman

*Attest:*

BRUCE LEHMAN

*Attesting Officer*

*Commissioner of Patents and Trademarks*